US008707595B2

(12) United States Patent
Beemsterboer et al.

(10) Patent No.: US 8,707,595 B2
(45) Date of Patent: Apr. 29, 2014

(54) RETRACTOR SAFETY DEVICE

(71) Applicants: Beau Steven Beemsterboer, Pittsburgh, PA (US); Ross Antone Beemsterboer, Monee, IL (US); Simon John Beemsterboer, Mokena, IL (US)

(72) Inventors: Beau Steven Beemsterboer, Pittsburgh, PA (US); Ross Antone Beemsterboer, Monee, IL (US); Simon John Beemsterboer, Mokena, IL (US)

( * ) Notice: Subject to any disclaimer, the term of this patent is extended or adjusted under 35 U.S.C. 154(b) by 0 days.

(21) Appl. No.: 13/648,410

(22) Filed: Oct. 10, 2012

(65) Prior Publication Data

US 2014/0077021 A1 Mar. 20, 2014

Related U.S. Application Data

(63) Continuation of application No. 13/617,684, filed on Sep. 14, 2012, now abandoned.

(51) Int. Cl.
*G09F 11/18* (2006.01)

(52) U.S. Cl.
USPC ..... 40/515

(58) Field of Classification Search
USPC ..... 160/11, 299; 242/385.4
See application file for complete search history.

(56) References Cited

U.S. PATENT DOCUMENTS

| | | | | |
|---|---|---|---|---|
| 2,354,832 | A * | 8/1944 | Ristine | 160/11 |
| 4,124,196 | A * | 11/1978 | Hipskind | 256/1 |
| 4,844,420 | A * | 7/1989 | Oster | 256/1 |
| 5,934,354 | A | 8/1999 | Price et al. | |
| 6,102,373 | A | 8/2000 | Amsinger | |
| 6,302,352 | B1 | 10/2001 | Applegate | |
| 6,494,065 | B2 * | 12/2002 | Babbitt, III | 70/177 |
| 6,536,698 | B2 * | 3/2003 | Hsu | 242/381.3 |
| 6,715,525 | B2 | 4/2004 | Ehrenberger et al. | |
| 7,108,241 | B2 | 9/2006 | Yoshino et al. | |
| 7,273,198 | B2 | 9/2007 | Tourtellotte et al. | |
| 7,690,858 | B1 | 4/2010 | Chiavola | |
| 7,806,483 | B2 | 10/2010 | Schultz | |
| 7,909,310 | B2 | 3/2011 | Weiner | |
| 2002/0162994 | A1 | 11/2002 | Langlie et al. | |
| 2003/0164485 | A1 | 9/2003 | Olson et al. | |
| 2004/0060499 | A1 | 4/2004 | Penque, Jr. | |
| 2006/0113519 | A1 | 6/2006 | Prismall | |
| 2008/0040959 | A1 | 2/2008 | Schultz | |
| 2008/0073872 | A1 | 3/2008 | Scott | |
| 2008/0251625 | A1 | 10/2008 | Bentley | |
| 2012/0119907 | A1 * | 5/2012 | Teuchert | 340/541 |

FOREIGN PATENT DOCUMENTS

DE 202005018054 U1 2/2006

OTHER PUBLICATIONS

Best Value Wall Mount Retractable Barriers, website http://www.globalindustrial.com, 2 pgs, Jan. 2012.
Crowd Control Barriers, Global Industrial, brochure, p. 238, printed from website http://www.globalindustrial.com on Jan. 26, 2012.

(Continued)

*Primary Examiner* — Joanne Silbermann
(74) *Attorney, Agent, or Firm* — Peter J. Borghetti; David G. Oberdick

(57) ABSTRACT

Retractor safety device for identifying and controlling hazardous areas associated with unmarked, unbarricaded or unprotected areas of Construction and General Industry work sites, as well as any application requiring pedestrian movement-control, designed to meet all required safety standards in terms of color and signage, and will incorporate a variety of elements to promote visibility and ease of use. Retractor safety device is an industrial-grade, reusable caution/danger/hazard tape retractor that attaches by means of a universal mounting bracket, includes a manually- or automatically-operated tape-locking mechanism, as well as a quick-connect, universal tape attachment with Lock-Out, Tag-Out (LOTO) capabilities, and field cleanable/maintainable.

47 Claims, 13 Drawing Sheets

(56) References Cited

OTHER PUBLICATIONS

12 FT Retractable Tape—Caution, website http://www.globalindustrial.com, 2 pgs, printed on Jan. 26, 2012.

Retractable Tape Barriers, website http://www.emedco.com/security-aids/security-barriers-traffic-aids/retractable-tape-barrier . . . , 2 pgs, printed on Aug. 14, 2012.

* cited by examiner

RETRACTOR SAFETY DEVICE

CROSS-REFERENCE TO RELATED APPLICATIONS

This application is a Continuation Application of U.S. Non-provisional application Ser. No. 13/617,684, filed Sep. 14, 2012, which is incorporated by reference herein.

FIELD OF THE INVENTION

The present invention is related generally to the field of safety equipment, in particular to retractor safety tape that is easily moved from one work site to another.

BACKGROUND OF THE INVENTION

A user of standard caution tape may tie the flexible, single-use caution tape from one end of, for example, a crane outrigger to the another end in an effort to protect people from entering the dangerous and deadly area known as the swing radius. The standard caution tape must be tied and untied each time the outrigger is moved. The standard caution tape is weak and flexible to the slightest of pressures and offers little to no resistance when pressed against, and frequently stretches to the point of deformation. Often times, the standard caution tape is improperly removed, leaving strands of torn tape tied to machinery and equipment, and many times in the form of a hanging-loop, which is itself a hazard. Standard caution tape has a tendency to tear easily, and many times it can be destroyed inadvertently from a variety of unforeseen events including safety violations, severe wind and weather, as well as wildlife destruction and vandalism. In addition, it is extremely wasteful and very costly to replace standard caution tape with each new use.

Users of standard caution tape include, but are not limited to, all companies under Occupational Safety and Health Administration (OSHA) and Mine Safety and Health Administration (MHSA) jurisdiction, as well as including all construction companies and general industry operations, such as hospitals, airports, police stations, fire departments, government buildings, and car care/automotive repair facilities. Further, companies like ArcelorMittal, US Steel, and BP have a need for such a product due to the high number of hazardous work areas that require protection. Generally, any company that uses standard caution tape, or any other form of area-protection or crowd/pedestrian control, is a potential customer.

Currently there is no product commercially available that is designed to meet all required safety standards in terms of color and indicia and performance, and that incorporates a variety of elements to promote high visibility, ease of use, situational versatility, and operational effectiveness.

SUMMARY OF THE INVENTION

The present invention is a retractor safety device for identifying and controlling hazardous areas associated with unmarked, unbarricaded or unprotected areas of construction and general industry work sites, as well as any application requiring pedestrian movement-control, designed to meet all required safety standards in terms of color and indicia and functionality. The retractor safety device will incorporate a variety of elements to promote visibility and ease of use. The retractor safety device will incorporate functions that promote increased ability to effectively protect from hazardous areas. The present invention is an industrial-grade reusable caution/danger/hazard tape retractor that can attach to a structure (such as an outrigger support post, a post, a wall, a stanchion, equipment, and machinery by means of a universal mounting bracket, includes a manually- or automatically-operated tape-locking mechanism, as well as a quick-connect, universal tape attachment with Lock-Out, Tag-Out (LOTO) capabilities, data logging, and is field cleanable/maintainable. Alternative embodiments of the present invention are integral with the structure or component of the structure (such as an outrigger support or side view mirror 130). Types of vehicles with a retractor safety device can be passenger vehicles, police vehicles, fire vehicles, public service vehicles, and other emergency vehicles.

The present invention, when compared to other options like standard caution tape and typical tape retractors, has increased versatility in mounting possibilities, self-cleaning, and includes a self-attaching tape connector and a tape locking-mechanism with LOTO capable. With regards to mounting, the present invention can be mounted to any surface/structural shape and the orientation of a mounting bracket to a mounting surface is not fixed along a single axis. The present invention is designed and built in a manner that meets all current and near-term safety standards, which yields a device that is specifically designed to save, time, money, and improved likelihood of preserving life and limb.

In one embodiment, the present invention functions to warn co-workers and others of the dangerous areas within the swing radius of a crane's operating radius by means of a well-defined temporary barrier that acts to cordon off the danger-zone in the area between, for example, outriggers.

In yet another embodiment of the present invention functions as an "area guard" and/or create "controlled access zone" and/or "warning line system" to mark and define the boundary for Fall Protection as prescribed in 29 CFR 1910. and 1926.

As mentioned above, one embodiment of the retractor safety device can be used in conjunction with crane outriggers either removably attached or permanently affixed (such as welded to the frame or support, or integrally formed in the body of the outrigger). In the removable embodiment, a user will attach the multi-purpose, universal mounting bracket to one outrigger on each side of the crane. The user will then attach the safety retractor housing unit to the mounting bracket where the mating surfaces of the housing and bracket are complementary surfaces of any shape and size. The housing unit may or may not be locked to the mounting bracket, by means of a LOTO-capable design feature. The user would then extend the tape-end to the corresponding outrigger via a self-connecting mechanism (such as a Carabineer and Magnetic d-ring), thereby deploying a semi-permanent area-protection barrier, as a means to meet federal requirements to protect a person from entering the deadly swing radius of the crane. The user may also extend the tape end to any other point within the tapes reach. The self-connecting mechanism attached to the tape end is also designed to be Locked-Out, Tagged-Out (LOTO)-capable if so desired. The user can then return to the safety retractor housing, and if so desired, has the option to engage the belt-locking mechanism, which tensions the belt, providing sufficient resistance so as not to deform under pressure, to a given specification. The belt-locking mechanism is also LOTO capable. If a user chooses to engage all LOTO-capabilities, the user will have effectively created a permanent area-protection barrier that meets all federal requirements for area protection relative to protecting against a cranes swing radius, as well being able to satisfy all LOTO requirements. The present invention may incorporate means of both active and/or passive warning systems to further promote safety such as, but not limited to, insignia, warning lights, audio warnings, flags, strobes, glow-in-the-dark materials, etc. The safety retractor may or may not also incorporate a data log used to track time, date, and duration of belt deployment to better aid organizations in tracking safety procedures and holding accountable those whose failure to follow such procedure. When the barrier is no longer required, the belt can be retracted into the housing, and the housing can be redeployed elsewhere, as needed. In addition, a user of the retractor safety device may extend the tape from its attached position on the crane to any other point within the tape's reach, via a self-connecting mechanism (i.e. Carabineer, Magnetic d-ring). When the barricade is no longer needed, the tape is disconnected from its attachment point, and retracts back into the housing of the retractor safety device.

There are many other applications for the retractor safety device including any scenario where a user may require standard caution tape to cordon off a potentially dangerous area. Another example of this use may be the need to cordon off a work area around a hazardous piece of equipment that needs periodic emergency repairs, and where the user desires to have a temporary barricade on-hand at all times, even on very limited notice, to insure against failed safety measures. All too often situations occur in which a plant mechanic, for example, fails to cordon off a danger-area, because he/she either doesn't have standard caution tape on hand, or they fail to be reminded of the requirement to do so. The retractor safety device, conversely, could be attached to a semi-permanent/permanent location for immediate use whenever it is needed. By virtue of the retractor safety device's design and the universal mounting plate being in a fixed location, it becomes much more likely that the plant mechanic will see the retractor safety device and be reminded to use it to cordon off and protect from potential hazards. Its ease of operation (i.e. no knots, no tangled tape, no tape cleanup, always on-hand) further promotes it's use. Once the retractor safety device is in place, there is little excuse not to use the retractor safety device. The universal mounting plate can also be locked to the retractor safety device and thus becoming a single unit.

Uses of the present invention include any hazard that must be barricaded or cordoned off, according to State and Federal regulations and standards including, but not limited to, OSHA, MSHA, and National Fire Prevention Association (NFPA). Possibly the most important embodiment for the invention, due to current products failure to meet both regulations as well operational standards and performance requirements, is to guard the swing radius between the outriggers of cranes, which is a relatively new mandate from OSHA. Additionally, the retractor safety device has uses at construction and general industry sites that are many due to the sheer number of situations that require barricades and/or warning systems that must meet or exceed specific standards and or requirements governed by many laws/organizations. The present invention can be used in accident investigation and site control. In addition, due to the innocence of public bystanders, the versatility of the universal mounting bracket allows the safety retractor to protect against hazards associated with activities related to police, fire, emergency response, etc.

Another example of the retractor safety device's use can be a temporary work situation, where an employee is asked to do repairs somewhat close to a potential hazard, such as moving equipment. In such a situation, standard caution tape may be ineffective because it fails to provide the necessary resistance needed to prevent an employee from backing into the hazard. The tensioning/locking feature of the retractor safety device will provide the necessary resistance to indicate to someone backing into it, and warning that they are beginning to break the plane designating safety from danger. There are many situation-specific uses that are non-obvious however, as many potential applications relate to temporary situations that are one-time events and completely unforeseeable and circumstantially unique and thus to innumerable to list.

With regards to meeting or fulfilling legal safety requirements, established business goals, and upcoming industry best practices, often times the currently available standard caution tape alone does not fully comply. The present invention differs from current technology being specifically designed (i.e. size, color, verbiage, etc.) to be a retractable and reusable, American National Standards Institute (ANSI) & OSHA prescribed warning/caution/danger tape that incorporates several features such as a universal backing plate, locking tape with minimum resistance (i.e. 16 lbs. min.), tape cleaner, housing has 'chimney' cleaning system, reflective tape, universal tape self-attaching end, lockable tape end and lockable retractor safety device to backing plate in addition to the housing and tape having built-in reusable "tag" for LOTO (Lock-Out, Tag-Out) (and tag only LOTO) applications.

In another embodiment of the present invention, the tape attachment end accepts a selectable strength "breakaway" connector (providing clean break/re-attachment point) allows the tape end attachment to disconnect under excessive pressure and be reattached cleanly without tools.

The universal mounting bracket allows the retractor safety device to be mounted in virtually any orientation. And since the universal mounting bracket can be mounted to a structure or surface by unlimited means, it can be mounted without the need for alteration (i.e. drilling holes) to the attaching structure. This feature represents an ability to attach the device in a variety of ways, in very diverse situations, without need for manufacture approval, which is currently an industry hurdle when using existing retractors. It also allows the retractor safety device to be moved from one hazardous location to another without the need for repeated mounting with tools, since a user may install a number of universal mounting brackets in multiple locations, moving only the retractor safety device as needed. Since the retractor safety device will be able to lock onto the universal mounting bracket, it can be fixed in a semi-permanent manner deterring theft or loss. The retractor safety device housing can be secured to the universal mounting bracket by means of traditional padlock such as for LOTO, key, numerical, electronically, and set screws. The housing and the mounting bracket can include complementary ears or loops with holes that are adjacent to each other when the universal mounting bracket slides onto the housing. A pad-lock, for example, can be inserted through holes of the complementary ears or loops to keep the housing and universal mounting bracket together until the lock is removed. Also, ears or loops can be used on the belt lock such that the switch or lever can be in the LOCK position and a pad-lock can be inserted through both keeping the switch or lever from having the ability to be switched back to the UNLOCK position.

The universal mounting bracket can be attached to the mounting surface in almost anyway such as cam-locking straps, screws, nails, zip-ties, rope, magnets, glue/epoxy, U Bolts, suction cups, adhesive tape, or any other conventional means.

The retractor safety device can also incorporate specifically designed reflective properties to provide visual warning, while specific designs would provide wordage describing the specific hazards being barricaded against.

For a better understanding of the present invention, reference is made to the accompanying drawings and detailed description.

BRIEF DESCRIPTION OF THE DRAWINGS

The present invention is illustratively shown and described in reference to the accompanying drawings, in which.

DETAILED DESCRIPTION OF THE INVENTION

As used herein in the specification and claims, including as used in the examples and unless otherwise expressly specified, all numbers may be read as if prefaced by the word "about", even if the term does not expressly appear. Also, any numerical range recited herein is intended to include all subranges subsumed therein.

Figure 1:
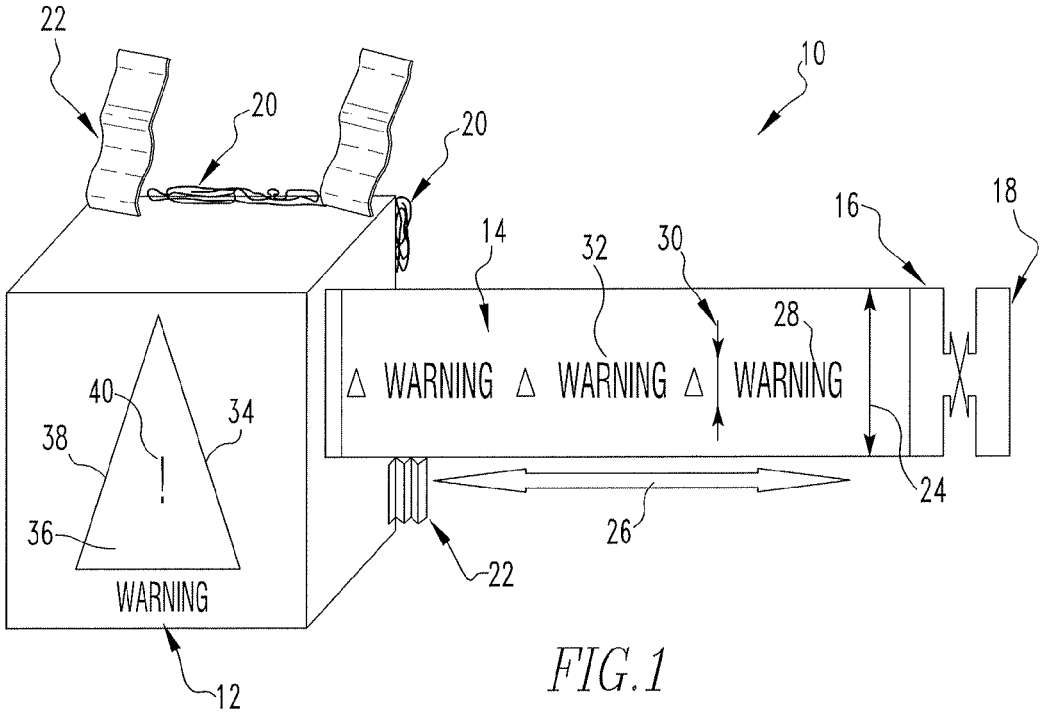
FIG. 1 is a pictorial illustration showing an exemplary embodiment of the present invention.
Figure 2:
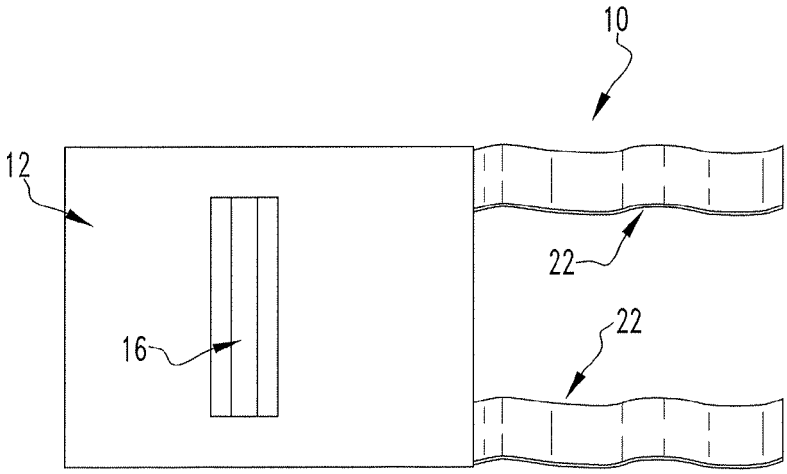
FIG. 2 is a side view of the exemplary embodiment of FIG. 1.

The retractor safety device 10 illustrated in prospective view of the exterior of retractor safety device 10 in FIGS. 1 and 2 includes a housing 12, retractable signal tape 14 with attachment end 16 connectable to equipment attachment end 18 (which is secured to, for example, an outrigger), padding 20, and attachment devices, such as straps 22. Straps 22 are of sufficient length to secure housing 12 to, for example, an outrigger. Alternative attachment devices can be magnets, hook-and-eyes, bolts, and screws. As way of an example and not as limitations, retractable signal tape 14 can be an orange or fluorescent color having a width 24 being any acceptable dimension (such as 3 inches) and length 26 being any acceptable dimension. One study indicates that orange is associated with crushing hazard and also conveys possibility of human injury or death, and yellow can mean property damage. The letters 28 imprinted on retractable signal tape 14 can be any visible color (such as black) and any acceptable height 30 (such as 2.75 inches) that will give the desired maximum safe viewing distance (such as 34.275 feet), which corresponds to letter height 30 of 2.75 inches. One embodiment of retractor safety device 10 employees the ratio of letter height 30 to desired safe viewing distance to 1:150. The font of letters 28 can be any acceptable font that provide clear and legible viewing at the desired safe viewing distance. One study indicates the signal word 32 being WARNING means the possibility of human hazard, and CAUTION can be used for property damage situations only. Housing 12 can include safety sign 34 being a triangular shape 36 with varying color combinations, such as a yellow triangle 36 with black outline 38 and black explanation mark 40, a black triangle with orange exclamation mark, or pinch point symbol with same colors as above. Tape end attachment 16 can incorporate a "breakaway" feature 16A that allows tape 14 to auto detach in the event of excessive force being applied and allow for a simple clean reattachment. The "breakaway" feature can be accomplished through a variety of means such as, but not limited to, magnetic, clip, or pin.

Figure 3:
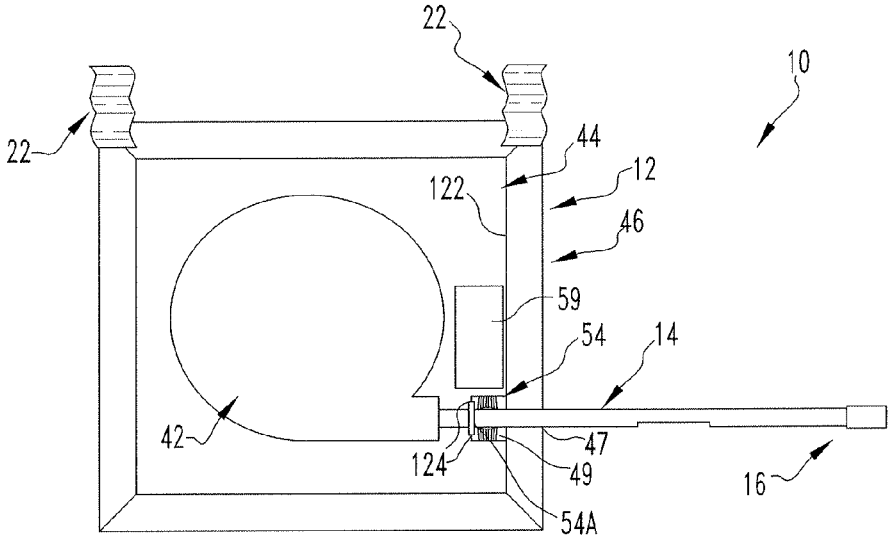
FIG. 3 is a top view of the exemplary embodiment of FIG. 1 without a cover to show the internal components.
Figure 4:
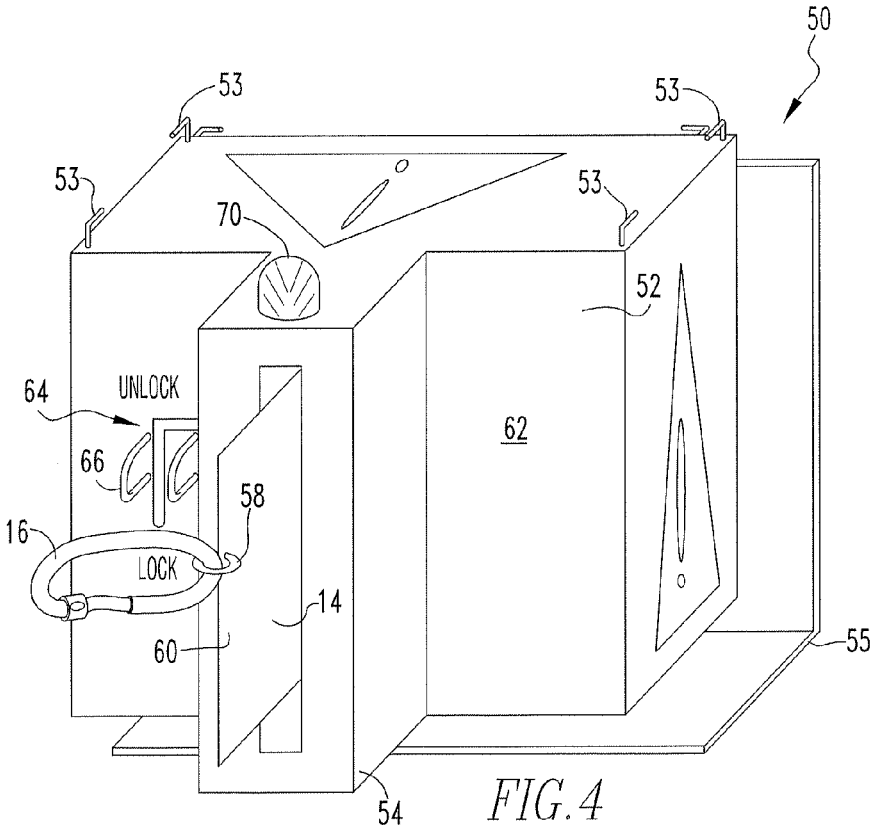
FIG. 4 is a perspective view of another exemplary embodiment of the present invention with an external tape cleaning section.

Now turning to FIG. 3 that illustrates a top view of the present invention 10 of FIG. 1 without a cover to show the internal components of housing 12. Tape retracting mechanism 42 is received into inner cavity 44 of housing 12, wherein housing 12 is constructed of 1 (cylinder or sphere) or more sides 46. Housing 12 is shown with 4 sides as an illustration and not as a limitation of the invention. Other geometric shapes, such as cylindrical and triangle, are also acceptable. Housing 12, 52 (see FIG. 4) can be made from two molded pieces (housing 12 and cover 12A) that allow for easy access to interior 44 for repair/replacement of interior components. Cover 12A can be the top surface as shown in FIG. 4 or a bottom surface (not shown). One side 46 can include an aperture 47, such as a slot or hole, to receive tape 14. A reusable gasket (not shown) can be used for sealing between the two molded pieces. Tape retractor mechanism 42 and tape 14 can easily slide out of housing 12 for repair/replacement. Tape 14 includes a first end (not shown) being wound around reel 42A (see FIG. 9A) the tape retractor mechanism 42 and a second end (equivalent to attachment end 16) being disposed through the aperture 47 of the housing 12. Tape retractor mechanism 42 can include a commercially available inertia locking mechanism (not shown) to lock the reel 42A and tape 14 at a desired length. Length of tape 14 can be any desirable length based on the need of the customer and the size of housing 12. For example, tape 14 can be 30 feet in length. Housing 12 and tape 14 can be made of suitable commercially available materials that are weather, fade, stain, cut, and ultraviolet radiation resistance as well as anti-microbial with high strength capabilities and reflective properties. For example, housing 12 can be made of industrial grade polymer to avoid electrical issues and certifications that are required if using metals. Further embodiments of housing 12 should not have sharp edges (rounded corners are preferred), and should state the intended uses and warning labels that apply to it.

Continuing with FIG. 3, a further embodiment of retractor safety device 10 can include a data logger 59 to collect pertinent information required for safety compliance. Data logger 59 can be battery or solar powered or both to automatically record safety critical information such as, but not limited to, the time/date the data logger 59 was deployed, time/date tape 14 was extracted/retracted, and employee ID of the employee who deployed the data logger 59. Though data logger 59 is illustrated in FIG. 3 as being retained within housing 12, data logger 59 can also be connected to the exterior surface of housing 12 (not shown). Data logger 59 can be any commercially available data collector/recorder. Data can be transmitted via wireless communications to a host computer with a processor or downloaded via wireless communications or wired communications locally to a handheld device. Data logger 59 can be permanently or removeably attached to housing 12, 52.

Now turning to FIG. 4 that illustrates a perspective view of another embodiment 50 of the present invention. Housing 52 is configured similar to housing 12 with the addition of a tape cleaning section 54 shown projecting outward from the main structure of housing 50 on the exterior surface 62 of housing 52, thereby not being disposed in inner cavity 44 of housing 12, 52. Tape cleaning 106 (FIGS. 9A and 9B) is capable of engaging the tape 14 while the tape 14 is being drawn from and retracted into the housing 12, 52. Tape cleaning section 54 can be integral formed with housing 52 in the same mold or single piece of material. Alternatively, tape cleaning section 54 can be a separately manufactured component (not shown) that is joined or attached to the exterior surface 62 of housing 52 by conventional methods including, but not limited to, welding, screws, bolts, adhesives/epoxy/resin/glue/tape, clamps/clasps, magnets, hook-and-eye device, interference fit mechanism, or other mechanical connectors. The bottom surface 56 of tape cleaning section 54 has a debris expulsion opening 56A (see FIGS. 8A-8C) to allow debris removed from tape 14 to gravitationally exit from tape-cleaning section interior 49 (see FIG. 3) but not allow water or other exterior elements into tape-cleaning section interior 49 such that no debris enters inner cavity 44 (see FIG. 3) of housing 12, 52. Debris expulsion opening 56A is positioned below the tape cleaning device 106 during operation such that debris removed from the tape 14 exits the debris expulsion opening 56A. An alternative embodiment of a tape cleaning section 54 illustrated in FIG. 3 can include a tape cleaning section 54 with the debris expulsion opening 56A in interior cavity 44 attached to interior side wall 122 of housing 12, but still isolating inner cavity 44 from debris retained in tape-cleaning section cavity 49. FIG. 4 further illustrates tape breakaway connector 58 at end 60 of tape 14 to retain equipment attachment end 16 to tape 14 until design loads are exceeded, at which time tape breakaway connector 58 will break to disconnect tape 14 from the equipment. One embodiment of the present inventions 10, 50 can include a commercially available warning light and audible warning system 70 shown in FIG. 4. The warning light and/or audible warning system can be activated simultaneously or individually, and when tape 14 is either deployed or retracted. The warning light and audible warning system 70 can be battery and/or solar powered. The warning light and/or warning light casing (not shown) can also be made of or coated with glow-in-the-dark material such that personnel in the area of retractor safety device 10, 50 will be warned of a hazard at night when the warning system 70 is not activated. Alternative embodiments can also include resilient edge flaps 124 located in either side of tape entry opening 54A to further remove any residual debris from tape 14.

Figure 9A:
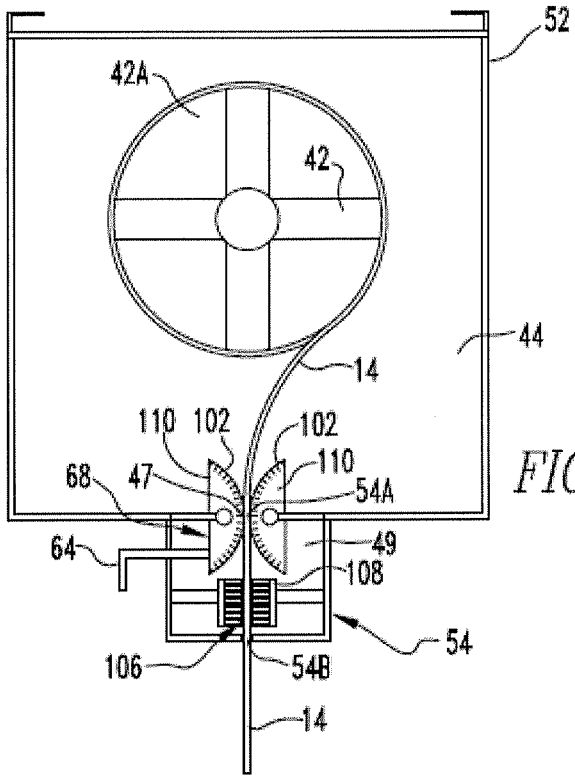
FIG. 9A is a top view of an exemplary embodiment of the retractor safety device housing without a cover to illustrate the internal components.
Figure 9B:
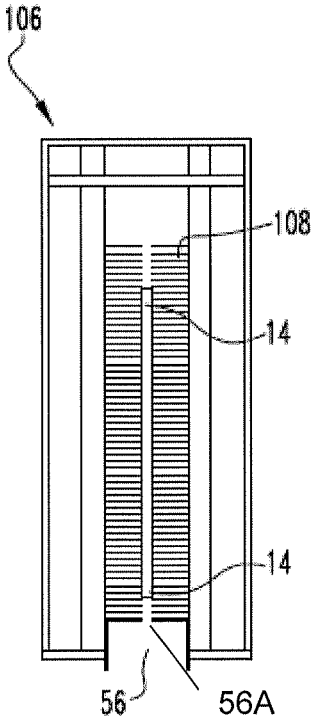
FIG. 9B is a pictorial illustration showing one embodiment of the tape cleaning mechanism.
Figure 9C:
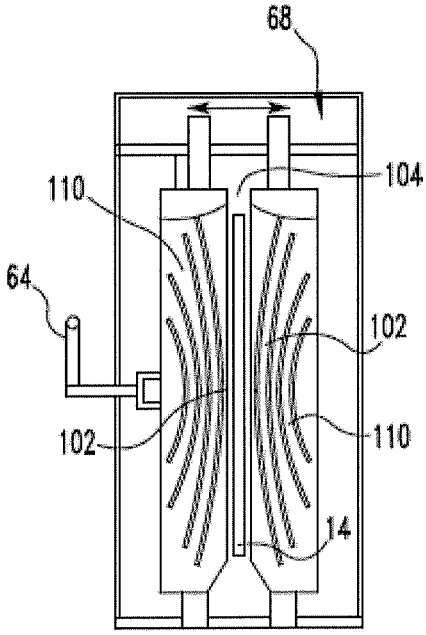
FIG. 9*c* is a pictorial illustration showing one embodiment of the tape locking mechanism.

Tape cleaning section 54 houses in its entirety or in part the tape-cleaning device 106 and tape-locking mechanism 68 as shown in FIGS. 9A-C. Tape 14 enters tape-cleaning section cavity 49 from inner cavity 44 of housing 12 through tape entry opening 54A and exits tape-cleaning section cavity 49 through tape exit opening 54B. Tape entry opening 54A and tape exit opening 54B are sized to receive tape 14. Tape entry opening 54A is adjacent to the aperture 47 of the housing 52. External tape lock activation mechanism 64 of tape locking control mechanism 68 is adjacent tape cleaning section 54 to activate locking cams 110 such that tape 14 engages locking cams 110 when tape locking mechanism 64 is activated. Tape locking mechanism device 64 is capable of engaging the tape 14 to inhibit the tape 14 for being drawn from and retracted into the housing 52. It should be understood that the tape lock activation mechanism 64 can be positioned on either side or both sides of the tape cleaning section 54 to accommodate either left handed or righted users. When the locking mechanism device 64 is engaged and disposed between Lock Out—Tag Out clasp 66 (see FIG. 4), a Lock Out—Tag Out device can be attached.

Figure 5A:
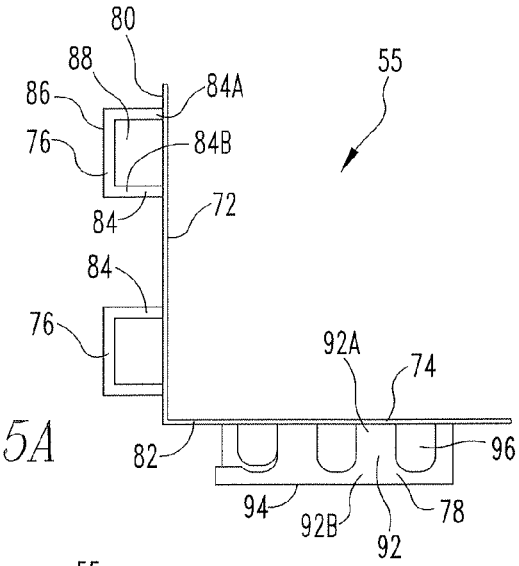
FIG. 5A is a side view of an exemplary universal mounting bracket of the present invention.
Figure 5B:
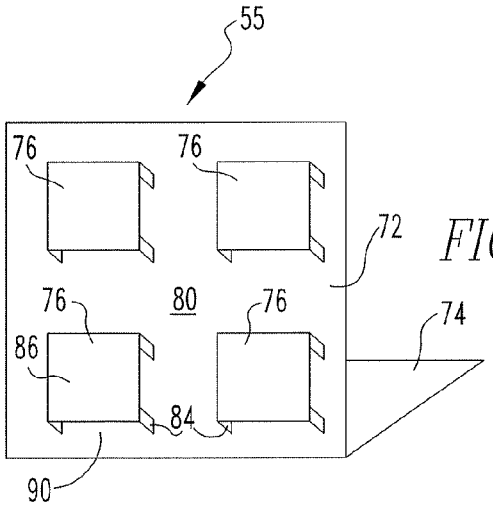
FIGS. 5B and 5C are perspective views of an exemplary universal mounting bracket of the present invention illustrating different surfaces with attachment devices.
Figure 5C:
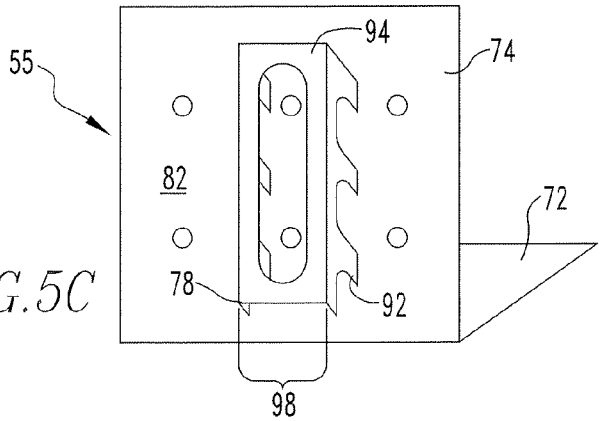

Now turning to FIGS. 5A-C illustrating one embodiment of universal mount bracket 55 having side one 72 and side two 74. Side one 72 can include two or more side attachment devices 76 on its exterior surface 80 to easily slide on and off of facilities apparatus or equipment with mating devices (not shown). Side attachment devices 76 can be a cluster of four (for illustration purposes only and not to limit the invention to any particular number of attachment devices) where each side attachment device 76 can include four legs 84 having an end 84A attached to exterior surface 80 and another end 84B attached to plate 86 to form a gap 88 between exterior surface 80 and plate 86, and openings 90 between legs 84 sized to receive a mating device (not shown) of the facilities apparatus or equipment. Side two 74 can include one or more side attachment devices 78 on its exterior surface 82 to easily slide on and off of facilities apparatus or equipment with mating devices (not shown). Bottom attachment device 78 can be one (for illustration purposes only and not to limit the invention to any particular number of attachment devices) or any cluster of attachment devices desirable. Each bottom attachment device 78 can include six legs 92 (or as many or as few legs as desired) having an end 92A attached to exterior surface 82 and another end 92B attached to top structure 94 to form a gap 96 between exterior surface 82 and top structure 94, and openings 98 between legs 92 sized to receive a mating device (not shown) of the facilities apparatus or equipment. Equipment attachment devices 76, 78 can be integrally formed from one piece of material or molded structure or joined together by any conventional techniques including, but not limited to, welding, screws, bolts, or clamps. Also, equipment attachment devices 76, 78 can be integrally formed with universal mounting bracket 55, such that universal mounting bracket 55 and equipment attachment devices 76, 78 are one, integral component and not a combination of separate sub-components assembled and joined into one assembly or one component. Surfaces 80, 82 can be no-slip, no-scratch surface such that the paint on the equipment is not scratch paint. The present invention universal mounting bracket 55 discussed above is versatile being able to connect to virtually anything, by any binding means (i.e. straps, glue, magnet, tape, hardware such as u-bolts, zipties, etc.), using the same mounting bracket. It is not limited to design-specific mounting techniques and does not require physical alteration to mounting surface. Universal mounting bracket 55 can be any geometric shape as is necessary to mate with various safety retractor housing designs including, but not limited to, concaved-cylindrical housing unit, which will require a concaved mounting plate. Retractor safety device 10, 50 is deployable without needing tools or a prop, such as a stanchion or cone, because of the universal mount bracket 55. Retractor safety device 10, 50 does not require use of special connecting bracket (male/female ends). Retractor safety device 10, 50 can be mounted on all plains of housing 12, 52 in any orientation: 1) mounted from the back, 2) mounted from the bottom 3) from the top, and 4) from either side.

Figure 6:
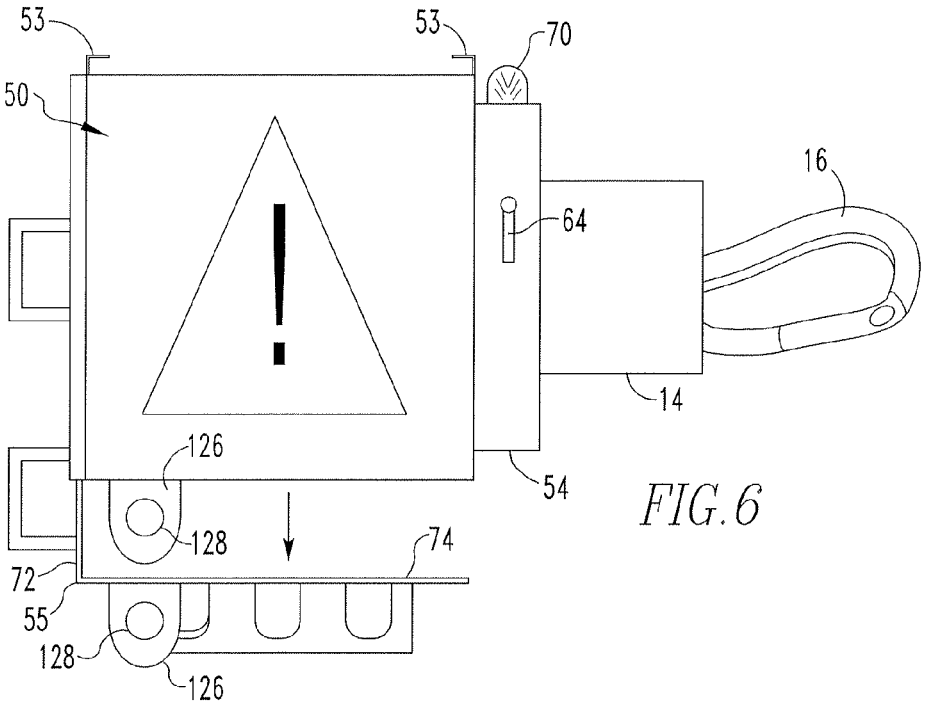
FIG. 6 is a pictorial illustration showing one embodiment of the retractor safety device partially engaged with the universal mounting bracket.
Figure 7:
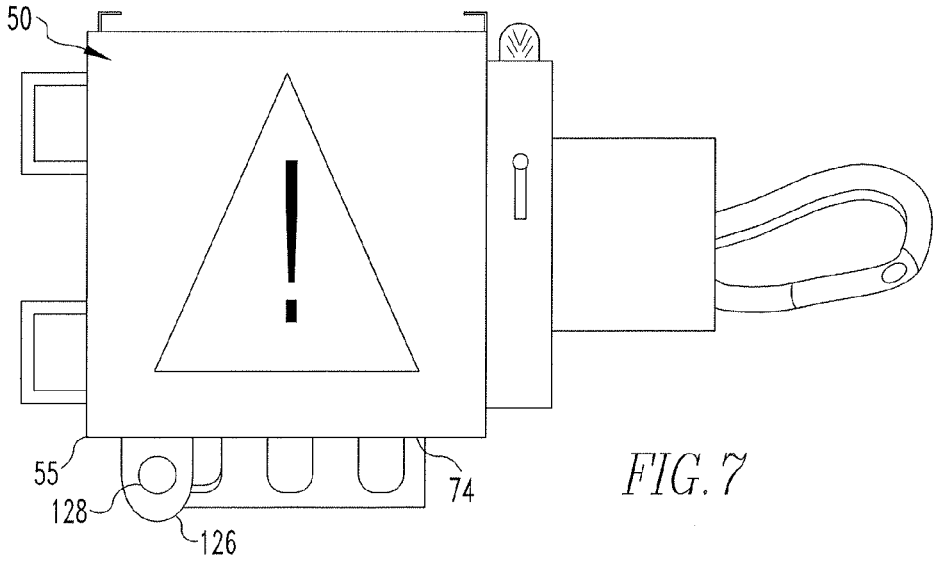
FIG. 7 is a pictorial illustration showing one embodiment of the retractor safety device fully engaged with the universal mounting bracket.

Now turning to FIG. 6 illustrating retractor safety device 50 partially engaged with universal mounting bracket 55. Housing 52 can also include mounting bracket receptor slots 53 to receive and retain universal mounting bracket 55 (see FIG. 4). During the assembly or installation operation, Retractor safety device 50 with mounting bracket receptor slots 53 sized to receive and retain side one 72 of universal mounting bracket 55 as side one 72 slides within mounting bracket receptor slots 53. Once retractor safety device 50 slides into full engagement with universal mounting bracket 55, retractor safety device 50 will sit securely on side two 74 as shown in FIG. 7. Since the retractor safety device 50 will be able to lock onto the universal mounting bracket 55, it can be fixed in a semi-permanent manner deterring theft or loss. The retractor safety device housing 52 can be secured to the universal mounting bracket 55 by means of traditional padlock 118 (see FIG. 10B) such as for LOTO, key, numerical, electronically, and set screws. The housing 52 and the mounting bracket 55 can include complementary ears or loops 126 with holes 128 that are adjacent to each other when the universal mounting bracket 55 slides onto the housing 52. A pad-lock 118, for example, can be inserted through holes 128 of the complementary ears or loops 126 to keep the housing 52 and universal mounting bracket 55 together until the lock 118 is removed. Also, ears or loops 126 with holes 128 can be used on the belt lock such that the switch or lever can be in the LOCK position and a pad-lock can be inserted through both keeping the switch or lever from having the ability to be switched back to the UNLOCK position. The universal mounting bracket 55 can be attached to the mounting surface in almost anyway such as cam-locking straps, screws, nails, zip-ties, rope, magnets, glue/epoxy, U Bolts, suction cups, adhesive tape, or any other conventional means.

Figure 8A:
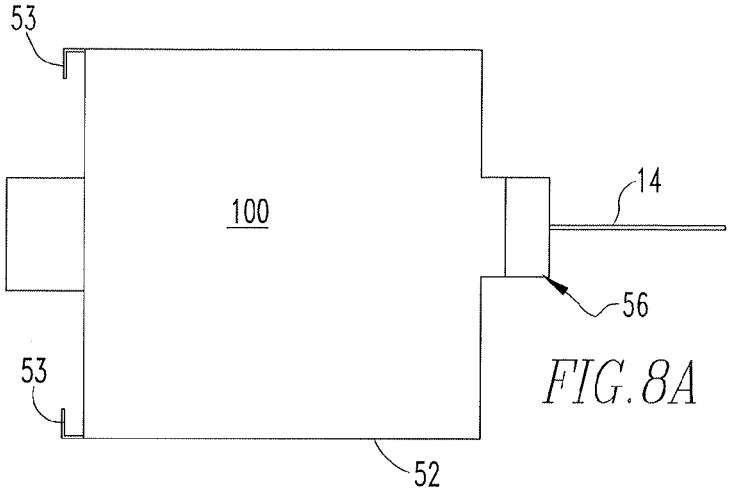
FIG. 8A is a bottom view of the retractor safety device housing of FIG. 4 without the universal mounting bracket.
Figure 8B:
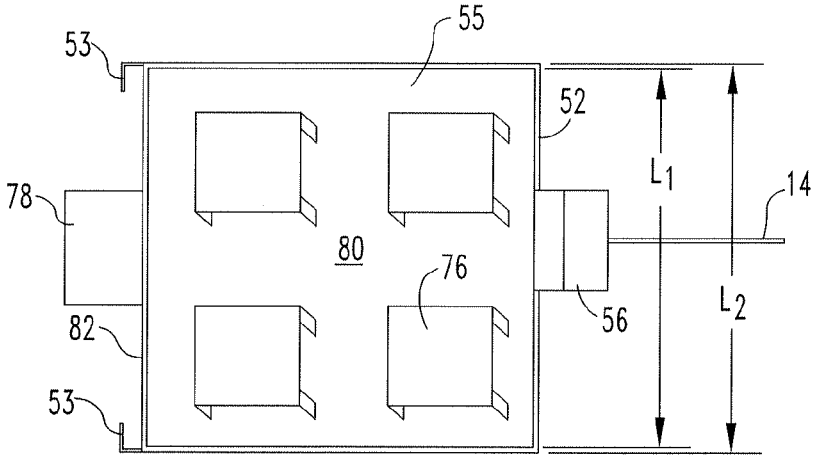
FIG. 8B is a bottom view of the mounting bracket with a plurality of attachment devices on bottom surface engaged with the retractor safety device housing of FIG. 4.
Figure 8C:
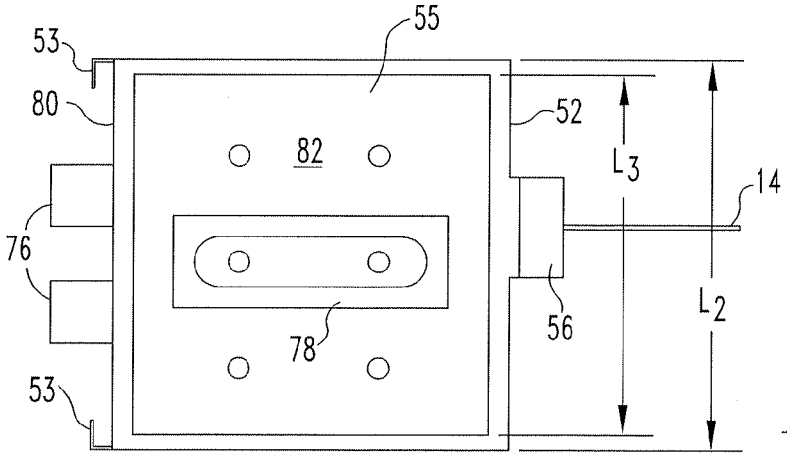
FIG. 8C is a bottom view of the universal mounting bracket with a singular attachment device on bottom surface engaged with the retractor safety device housing of FIG. 4.

Now turning to FIGS. 8A-C illustrating retractor housing 52 from a bottom view before and after installation of the universal mounting bracket 55. Universal mounting bracket 55 can be installed at least two different ways to position attachment devices 76, 78 relative to retractor housing 52 for engagement with a facilities apparatus or equipment. FIG. 8A illustrates a bottom view of retractor housing 52 showing bottom surface 100, debris expulsion opening 56A, tape 14, and mounting bracket receptor slots 53. FIGS. 8B and 8C illustrate retractor housing 52 and universal mounting bracket 55 being fully engaged. As shown in FIG. 8B, Length $L_1$ of side one 72 is less than length $L_2$ between opposing of mounting bracket receptor slots 53. The difference in lengths ($L_2$–$L_1$) provides sufficient clearance for side one 72 to freely slide between mounting bracket receptor slots 53 into the engaged position. As shown in FIG. 8C, Length $L_3$ of side two 74 is less than length $L_2$ between opposing of mounting bracket receptor slots 53. The difference in lengths ($L_2$–$L_3$) provides sufficient clearance for side two 74 to freely slide between mounting bracket receptor slots 53 into the engaged position.

Now turning to FIGS. 9A-C that illustrates internal components of retractor housing 52 (which are also compatible for use with retractor housing 12). Tape 14 is wound around tape retracting mechanism 42 and fed between tape gripping surfaces 102 of opposing locking cams 110 of tape locking control mechanism 68. The two gripping surfaces 102 are positioned parallel to each other. Tape lock activation mechanism 64 moves one or both of the opposing locking cams 110 (relative movement of cams 110 to each other): i) inward to close a gap 104 between cams 110 to substantial a zero gap to frictionally secure tape 14 between tape gripping surfaces 102 such that tape 14 is locked and only able to move under a maximum desire load (i.e. 16 lbs.) or pressure, and ii) outward to open the gap 104 between cams 110 sufficient to frictionally release tape 14 such that tape 14 is free to be drawn out from housing 52 (similar to housing 12) or free to retract into housing 52 as tape retractor mechanism 42 re-winds by a conventional biasing mechanism (for example, a spring). An alternative tape locking mechanism can be a reel inertia locking mechanism incorporated into the tape retractor mechanism 42.

Figure 9D:
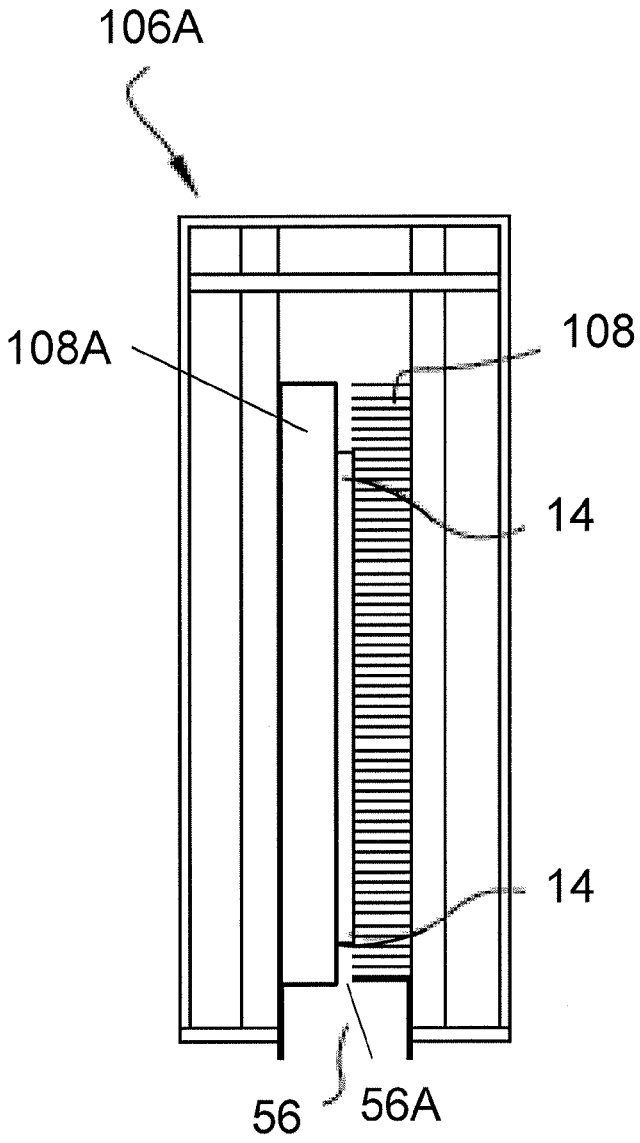
FIGS. 9D and 9E are pictorial illustrations showing embodiments of the tape cleaning device having one scrapper and one brush, and two scrappers, respectively.
Figure 9E:
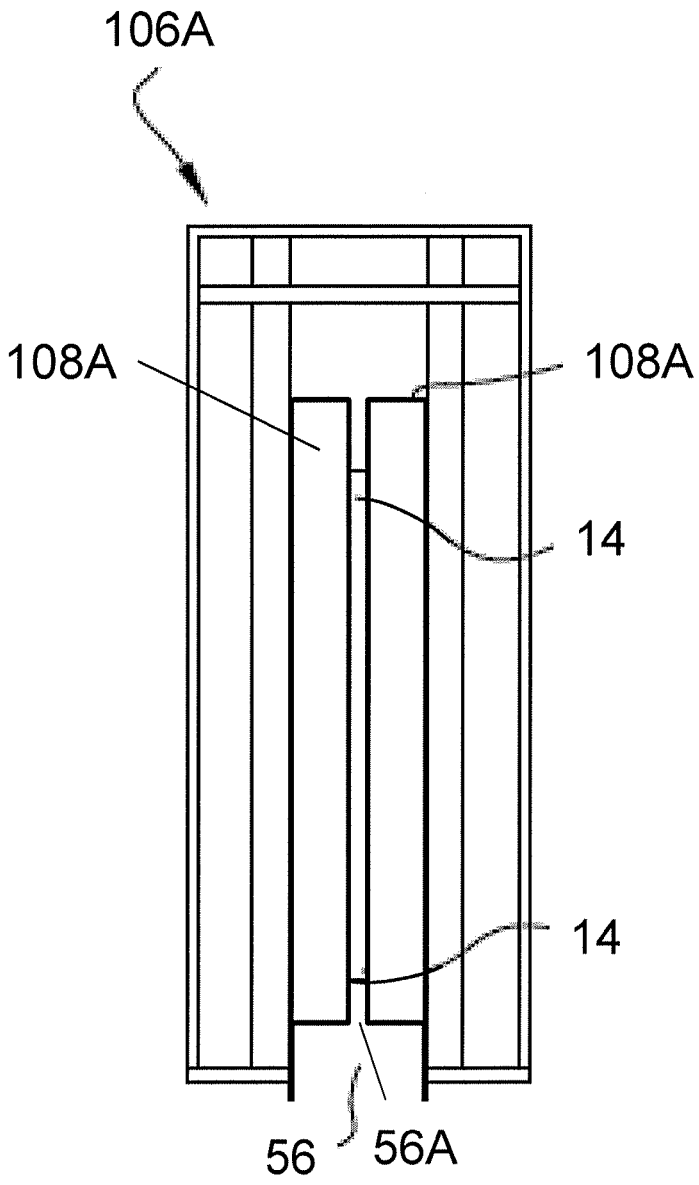

As tape 14 is re-wound onto tape retractor mechanism 42, tape 14 is cleaned of debris by tape cleaning device 106 that can includes one or more brushes 108. Though FIGS. 9A-9B illustrate two brushes 108, other embodiments 106A of the present invention can include scrapper 108A to replace both brushes 108 (see FIG. 9E) or one brush 108 (see FIG. 9D) such that brush 108 opposes a scrapper 108A or high pressure fluid (air, water, cleaning solvent, or combinations thereof). Debris removed from tape 14 will fall through debris expulsion opening 56A by way of gravity (without a medium) or fluid (with a medium—air pressure or flow of water or cleaning solvent).

Figure 10A:
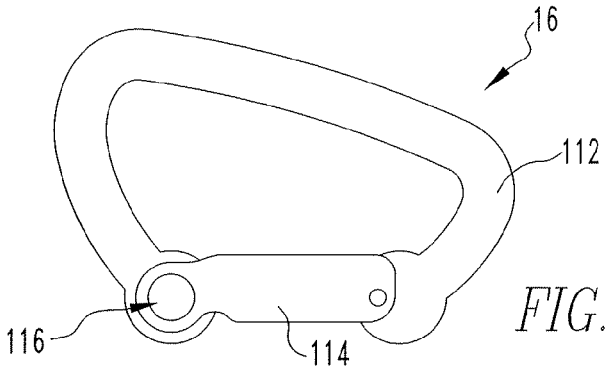
FIGS. 10A-C are pictorial illustrations showing one embodiment of lock out tag out mechanism.
Figure 10B:
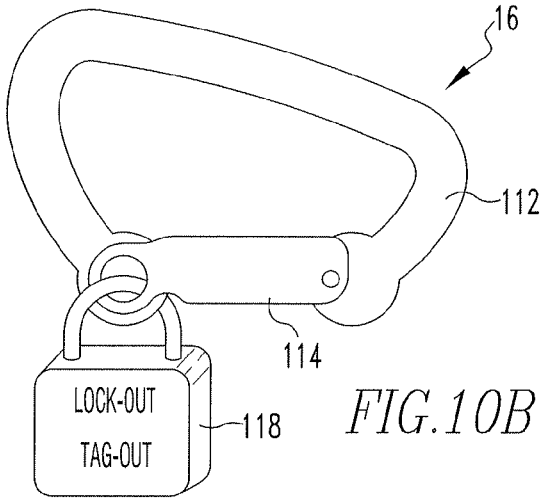
Figure 10C:
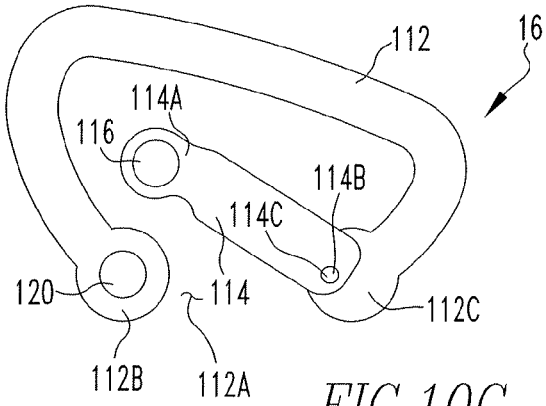

Now turning to FIGS. 10A-C illustrating one embodiment of attachment end 16 named a carabineer that includes a main structure 112 being substantially C-shaped forming an opening 112A between ends 112B, 112C and having clasp 114 pivotally attached to end 112C. Main structure 112 can include lock out tag out aperture 120 on end 112B that aligns with lock out tag out aperture 116 on end 114A of clasp 114 when clasp 114 is in a closed position as shown in FIGS. 10A and 10B. Main structure 112 also includes pivot hole (not shown) on end 112C that aligns with pivot hole 114C on end 114B of clasp 114 to pivotally connect main structure 112 with clasp 112. When clasp 112 is in the closed position, lock out tag out lock 118 can be fed through apertures 116, 120 to secure clasp 114 to main structure 112. Typically, attachment end 16 will be mated with or couple to equipment attachment end 18 (see FIG. 1) and lock out tag out lock 118 will be attach to secure the connection.

Figure 11A:
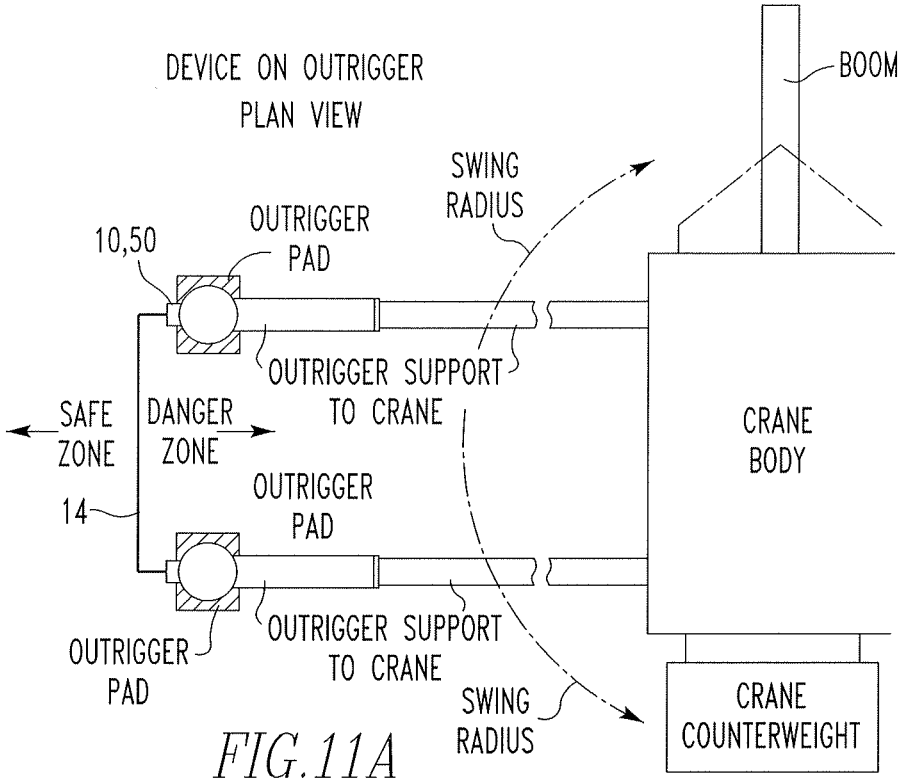
FIG. 11A is a plan view of one embodiment of the present invention attached to an outrigger.
Figure 11B:
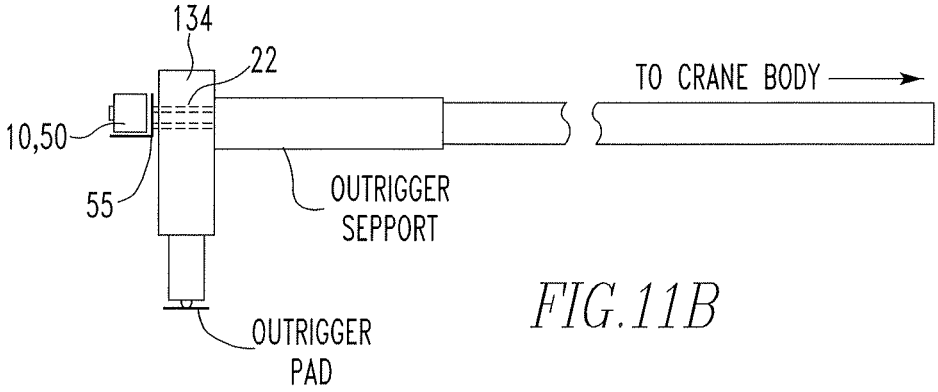
FIG. 11B is a side view of the present invention attached to an outrigger.

FIGS. 11A and 11B illustrate one embodiment of the present invention having the present invention 10, 50 removably attached to an outrigger support post 134. An alternative embodiment of the present invention incorporates housing 12, 52 into the body of the outrigger or outrigger support when formed during manufacturing of the subject support, whereby housing 12, 52 are integral with one or more components of the outrigger.

Figure 12A:
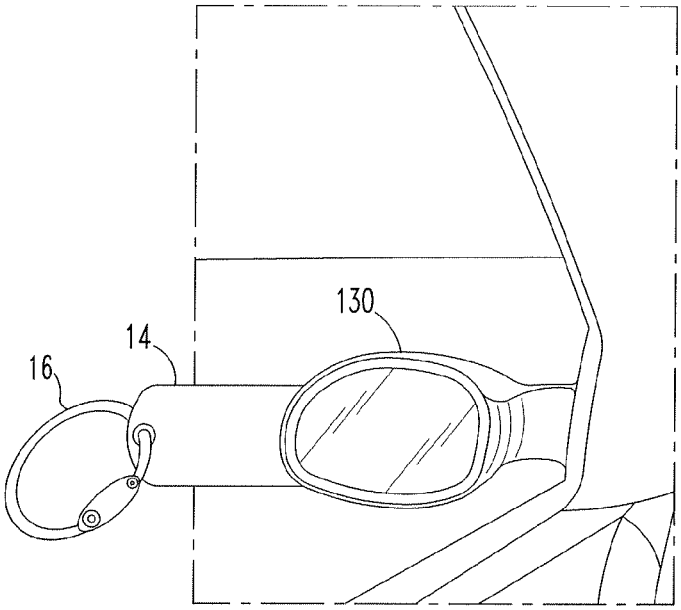
FIGS. 12A-C are pictorial views of embodiments of the present invention incorporated into side view mirrors of a vehicle and front bumper attachment to an emergency vehicle.
Figure 12B:
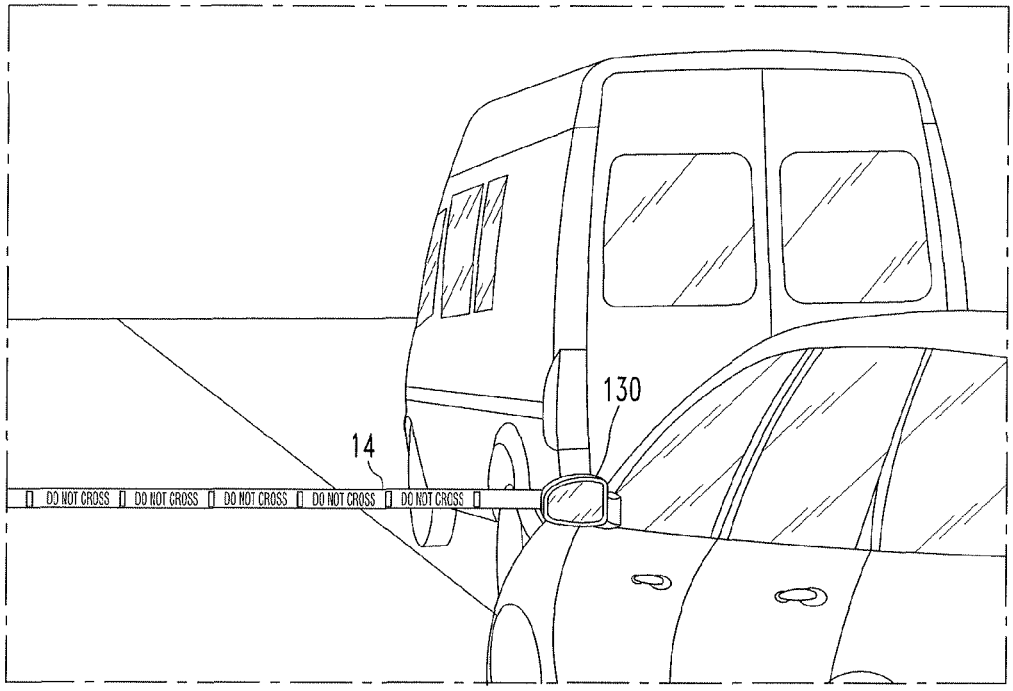
Figure 12C:
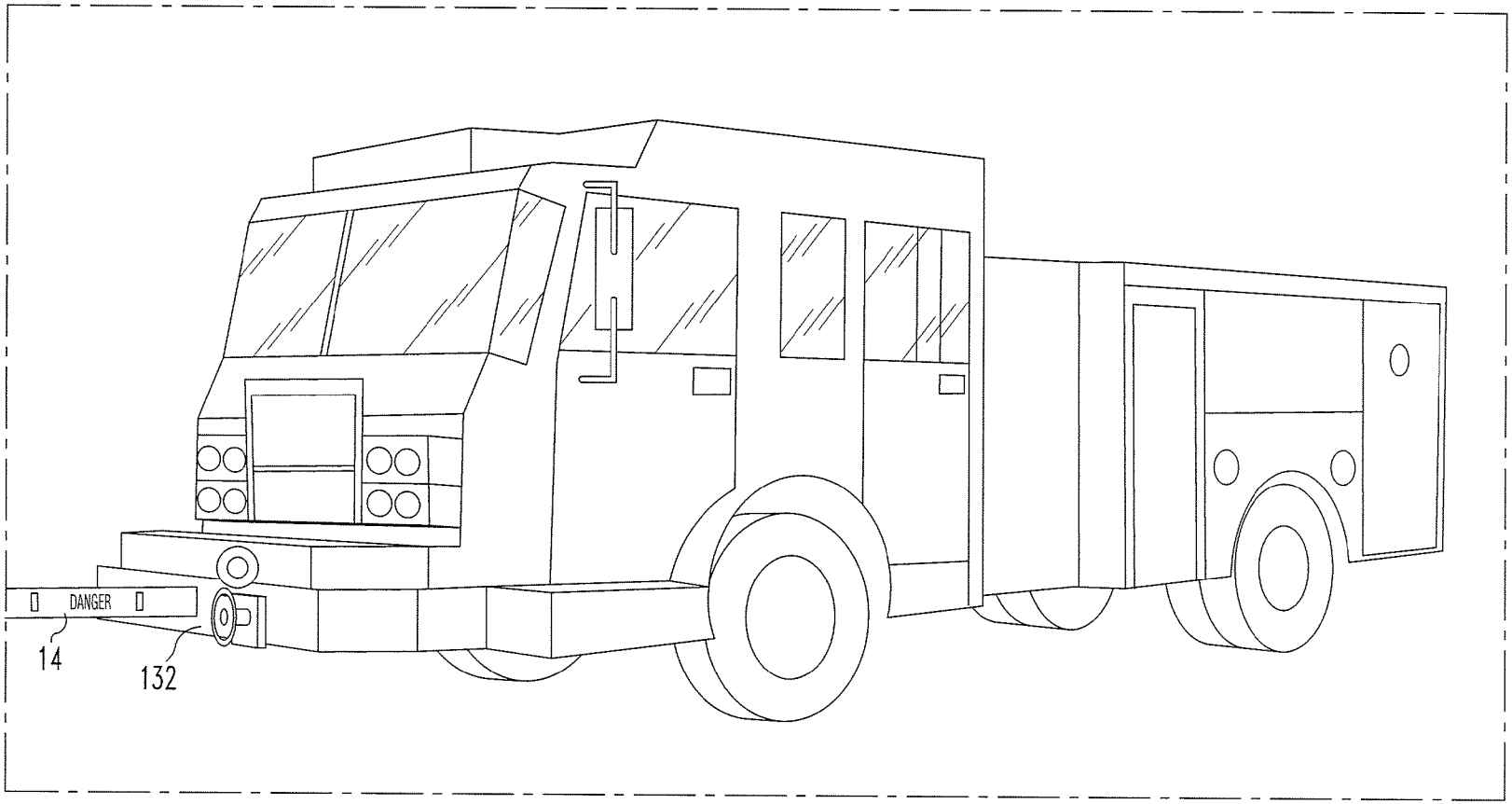

Further examples of an integral retractor safety device are embodied in side view mirrors 130 illustrated in FIGS. 12A and 12B and vehicle structure attachment 132 illustrated in FIG. 12C show as being attached to a bumper as an example and not as a limitation. Key components of the retractor safety device discussed above can be incorporated into the side view mirror 130 and vehicle attachment 132 includes, but not limited to, tape retracting mechanism 42, tape 14, attachment end 16, tape cleaning section 54, tape cleaning device 106, and tape locking mechanism 64. Side view mirror 130 and vehicle attachment 132 can be attached to any vehicle including, but not limited to, passenger vehicles, police vehicles, fire vehicles, public service vehicles, and other emergency vehicles.

As mentioned above, retractor safety device 10, 50 can include many safety markings and features to assure users are aware of dangerous surroundings. Listed below for illustration purposes, and not to limit the invention, are examples of possible safety markings and features pertaining to the present invention:

A. Signal tape can be Orange, 3" Height minimum;

B. Letters can be Black, 2.75" Height Minimum. This will give a max viewing distance of; 34.375 ft. (minimum letter height for signal word shall be 1 unit of height for every 150 units of safe viewing distance);

C. Use Headline style text;

D. Tape 14 can be ORANGE back ground with BLACK letters (z535-2007 revised standard). Orange is associate with crushing hazard and also conveys possibility of human injury or death/yellow can mean property damage;

E. Signal Word can be WARNING. WARNING means possibility of human hazard, CAUTION can be used for property damage situations only; and F. Use triangle safety sign, located on the left side of the word WARNING with a Black triangle with orange explanation mark, or Yellow triangle with black outline and black explanation mark, or pinch point symbol with same colors as above.

Another embodiment of the present invention can comply with statutory regulations including, but not limited to:

A. Part vi of the Manual of Uniform Traffic Control Devices(MUTCD)1993 edition FHWA-SA-94-027 and referenced publications;

B. American National Standards Institute (ANSI) Z35.1-1968, Z35.2-1968, Z535 standards and referenced publications;

C. Occupation Safety and Health Administration (OSHA) 29 CFR 1910.144;

D. OSHA 29 CFR 1926.200; and

E. OSHA 29 CFR 1926, 29 CFR 1910 and the general duty clause.

Although the present invention has generally been described in terms of specific embodiments and implementations, the present invention is applicable to other methods, apparatuses, systems, and technologies. The examples provided herein are illustrative and not limiting, and other variations and modifications of the present invention are contemplated. Those and other variations and modifications of the present invention are possible and contemplated, and it is intended that the foregoing specification and the following claims cover such modifications and variations.

The invention claimed is:

1. A retractor safety device comprising:

a housing having an interior cavity and an aperture;

a tape retractor mechanism retained within the interior cavity of the housing, a tape having a length, a width, a first end and a second end, wherein the first end of the tape being wound around the tape retractor mechanism and the second end of the tape being capable of being disposed through the aperture of the housing; and a tape cleaning section connected to the housing;

wherein the tape cleaning section comprises:

a first opening through a first wall, a second opening through a second wall, a third opening through a third wall, a fourth wall, a fifth wall, a sixth wall, an interior cavity formed by the first, second, third, fourth, fifth, and sixth walls being connected together to form a substantially sealed enclosure to prevent the influx of debris into the tape cleaning section, and a tape cleaning device retained within the tape cleaning section interior cavity;

wherein the third wall is perpendicularly oriented relative to the first and the second walls;

wherein a length and a width of the second opening are substantially the same as the length and the width of the tape;

wherein the first opening is adjacent to the aperture of the housing; and wherein the third opening is positioned below the tape cleaning device during operation such that debris removed from the tape gravitationally exits the third opening.

2. The retractor safety device according to claim 1, wherein:

the housing further comprises mounting bracket receptor slots; and a mounting bracket capable of engagement with the mounting bracket receptor slots, wherein the mounting bracket comprises at least two sides, wherein each side comprises at least one attachment device capable of engagement with at least one complementary mating attachment device of a piece of equipment or the facility structure.

3. The retractor safety device according to claim 1, further comprising a tape locking mechanism connected to the housing, wherein the tape engages with the tape locking mechanism when the tape locking mechanism is activated.

4. The retractor safety device according to claim 3, wherein the housing further comprises a lock out tag out connection in proximity of the tape locking mechanism such that the tape locking mechanism can be disposed within the lock out tag out connection when the tape locking mechanism is engaged and a lock out tag out device can be attached to the lock out tag out connection such that the tape locking mechanism is retained in an engaged position.

5. The retractor safety device according to claim 3, wherein the tape locking mechanism comprising a first gripping surface, a second gripping surface in parallel relationship to the first gripping surface, and a tape lock activation mechanism, wherein the tape lock activation mechanism is connected to the first gripping surface to cause relatively movement of the first gripping surface to the second gripping surface.

6. The retractor safety device according to claim 5, further comprising a second lock out tag out connection in proximity of the tape locking mechanism such that the tape locking mechanism can be disposed within the lock out tag out connection when the tape locking mechanism is engaged and a lock out tag out device can be attached to the lock out tag out connection such that the tape locking mechanism is retained in an engaged position.

7. The retractor safety device according to claim 1, wherein the second end of the tape comprising a lock out tag out connection.

8. The retractor safety device according to claim 1, further comprising a passive or an active warning system connected to the housing.

9. The retractor safety device according to claim 1, further comprising a data log connected to the housing.

10. The retractor safety device according to claim 1, wherein the second end of the tape comprises a breakaway feature.

11. The retractor safety device according to claim 1, wherein the tape cleaning device comprising one or more brushes.

12. The retractor safety device according to claim 1, wherein the tape cleaning device comprising one or more scrappers.

13. The retractor safety device according to claim 1, further comprising an end attachment connected to the second end of the tape, wherein the end attachment comprises:

a main structure being substantially C-shaped forming an opening between a first end and a second end, wherein the first end includes an aperture and the second end includes a pivot hole; and a clasp having a first end and a second end, wherein the first end includes an aperture and the second end include a pivot hole, wherein the pivot hole of the clasp is aligned with the pivot hole of the main structure and pivotally connected therewith to pivotally join the main structure to the clasp, wherein the aperture of the main structure aligns with the aperture of the clasp when the clasp is in the closed position such that a locking device can be disposed through the aperture of the main structure and the aperture of the clasp to secure the connection.

14. The retractor safety device according to claim 1, further comprising at least one attachment device, wherein the at least one attachment device is selected from a group consisting of a strap, a magnet, a hook-and-eye, a bolt, and a screw.

15. The retractor safety device according to claim 1, further comprising at least one attachment device, wherein the at least one attachment device comprises two or more legs connected to a plate forming a gap, wherein the gap being sized to receive at least one complementary mating attachment device of the piece of equipment or the facility structure.

16. The retractor safety device according to claim 1, wherein the housing and the tape contains warning labels.

17. The retractor safety device according to claim 1, wherein the tape cleaning section is retained within the interior cavity of the housing.

18. The retractor safety device according to claim 1, wherein the tape cleaning section is connected to an exterior surface of the housing.

19. The retractor safety device according to claim 1, further comprising a mounting bracket slideably engageable with the housing.

20. The retractor safety device according to claim 19, wherein the mounting bracket further comprises a locking hole, and the housing further comprises a locking hole, wherein the mounting bracket locking hole and the housing locking hole are aligned when the mounting bracket and housing are engaged such that a locking device can secure together the mounting bracket and the housing.

21. The retractor safety device according to claim 1, wherein the housing is integrated into an automobile side mirror or a vehicle structure attachment.

22. The retractor safety device according to claim 21, wherein the vehicle structure attachment is a bumper attachment.

23. The retractor safety device according to claim 1, wherein the housing is integrated into a support of an outrigger.

24. The retractor safety device according to claim 1, further comprising an end attachment connected to the second end of the tape, wherein the end attachment comprises:

a main structure being substantially C-shaped forming an opening between a first end and a second end, wherein the first end includes an aperture and the second end includes a pivot hole; and a clasp having a first end and a second end, wherein the first end includes an aperture and the second end include a pivot hole, wherein the pivot hole of the clasp is aligned with the pivot hole of the main structure and pivotally connected therewith to pivotally join the main structure to the clasp, wherein the aperture of the main structure aligns with the aperture of the clasp when the clasp is in the closed position such that a locking device can be disposed through the aperture of the main structure and the aperture of the clasp to secure the connection.

25. The retractor safety device according to claim 1, further comprising a tape inertia locking mechanism connected to the tape retractor mechanism.

26. A retractor safety device comprising:

a housing having an interior cavity, an aperture, and mounting bracket receptor slots;

a tape retractor mechanism retained within the interior cavity of the housing, a tape having a first end and a second end, wherein the first end of the tape being wound around the tape retractor mechanism and the second end of the tape being capable of being disposed through the aperture of the housing;

a tape cleaning section connected to the housing;

wherein the tape cleaning section comprises:

a first opening through a first wall, a second opening through a second wall, a third opening through a third wall, a fourth wall, a fifth wall, a sixth wall, an interior cavity formed by the first, second, third, fourth, fifth, and sixth walls being connected together to form a substantially sealed enclosure to prevent the influx of debris into the tape cleaning section, and a tape cleaning device retained within the tape cleaning section interior cavity;

wherein the third wall is perpendicularly oriented relative to the first and the second walls;

wherein a length and a width of the second opening are substantially the same as the length and the width of the tape;

wherein the first opening is adjacent to the aperture of the housing; and wherein the third opening is positioned below the tape cleaning device during operation such that debris removed from the tape gravitationally exits the third opening;

a mounting bracket capable of engagement with the mounting bracket receptor slots, wherein the mounting bracket comprises at least two sides, wherein each side comprises at least one attachment device capable of engagement with at least one complementary mating attachment device of a piece of equipment or the facility structure;

a tape locking mechanism connected to the housing;

a first lock out tag out connection connected to the second end of the tape;

a passive or an active warning system; and a data log connected to the housing.

27. The retractor safety device according to claim 26, wherein the tape locking mechanism comprising a first gripping surface, a second gripping surface in parallel relationship to the first gripping surface, and a tape lock activation mechanism, wherein the tape lock activation mechanism is connected to the first gripping surface to cause relatively movement of the first gripping surface to the second gripping surface, and a second lock out tag out connection in proximity of the tape locking mechanism such that the tape locking mechanism can be disposed within the lock out tag out connection when the tape locking mechanism is engaged and a lock out tag out device can be attached to the lock out tag out connection such that the tape locking mechanism is retained in an engaged position.

28. The retractor safety device according to claim 26, wherein the housing is integrated into a vehicle side mirror or a vehicle structure attachment.

29. The retractor safety device according to claim 28, wherein the vehicle structure attachment is a bumper attachment.

30. The retractor safety device according to claim 26, wherein the housing is integrated into a support of an outrigger.

31. The retractor safety device according to claim 26, further comprising an end attachment connected to the second end of the tape, wherein the end attachment comprises:

a main structure being substantially C-shaped forming an opening between a first end and a second end, wherein the first end includes an aperture and the second end includes a pivot hole; and a clasp having a first end and a second end, wherein the first end includes an aperture and the second end include a pivot hole, wherein the pivot hole of the clasp is aligned with the pivot hole of the main structure and pivotally connected therewith to pivotally join the main structure to the clasp, wherein the aperture of the main structure aligns with the aperture of the clasp when the clasp is in the closed position such that a locking device can be disposed through the aperture of the main structure and the aperture of the clasp to secure the connection.

32. The retractor safety device according to claim 26, wherein the tape engages with the tape locking mechanism when the tape locking mechanism is activated.

33. The retractor safety device according to claim 26, further comprising a tape inertia locking mechanism connected to the tape retractor mechanism.

34. The retractor safety device according to claim 26, wherein the second end of the tape comprising a lock out tag out connection.

35. The retractor safety device according to claim 26, wherein the housing further comprises a lock out tag out connection in proximity of the tape locking mechanism such that the tape locking mechanism can be disposed within the lock out tag out connection when the tape locking mechanism is engaged and a lock out tag out device can be attached to the lock out tag out connection such that the tape locking mechanism is retained in an engaged position.

36. The retractor safety device according to claim 26, further comprising a passive or an active warning system connects to the housing.

37. The retractor safety device according to claim 26, wherein the second end of the tape comprises a breakaway feature.

38. The retractor safety device according to claim 26, wherein the tape cleaning device comprising one or more brushes.

39. The retractor safety device according to claim 26, wherein the tape cleaning device comprising one or more scrappers.

40. The retractor safety device according to claim 26, wherein the tape locking mechanism comprising a first gripping surface, a second gripping surface in parallel relationship to the first gripping surface, and a tape lock activation mechanism, wherein the tape lock activation mechanism is connected to the first gripping surface to cause relatively movement of the first gripping surface to the second gripping surface.

41. The retractor safety device according to claim 26, wherein the at least one attachment device, wherein the at least one attachment device is selected from a group consisting of a strap, a magnet, a hook-and-eye, a bolt, and a screw.

42. The retractor safety device according to claim 26, wherein the at least one attachment device is a structure, wherein the at least one attachment device comprises two or more legs connected to a plate forming a gap, wherein the gap being sized to receive the at least one complementary mating attachment device of the piece of equipment or the facility structure.

43. The retractor safety device according to claim 26, wherein the housing and the tape contains warning labels.

44. The retractor safety device according to claim 26, wherein the tape cleaning section is retained within the interior cavity of the housing.

45. The retractor safety device according to claim 26, wherein the tape cleaning section is connected to an exterior surface of the housing.

46. The retractor safety device according to claim 26, wherein the mounting bracket is slideably engageable with the housing.

47. The retractor safety device according to claim 26, wherein the mounting bracket further comprises a locking hole and the housing further comprises a locking hole, wherein the mounting bracket locking hole and the housing locking hole are aligned when the mounting bracket and housing are engaged such that a locking device can secure together the mounting bracket and the housing.

* * * * *